US011885086B2

(12) United States Patent
Kushner et al.

(10) Patent No.: US 11,885,086 B2
(45) Date of Patent: Jan. 30, 2024

(54) ADJUSTABLE BLADE ASSEMBLY

(71) Applicant: Caterpillar Inc., Peoria, IL (US)

(72) Inventors: Jeremy Kushner, Raleigh, NC (US); Mathew Chance Frana, Holly Springs, NC (US); Lucas G. De Caroli, Cary, NC (US)

(73) Assignee: Caterpillar Inc., Peoria, IL (US)

( * ) Notice: Subject to any disclaimer, the term of this patent is extended or adjusted under 35 U.S.C. 154(b) by 373 days.

(21) Appl. No.: 17/247,208

(22) Filed: Dec. 3, 2020

(65) Prior Publication Data

US 2022/0178099 A1 Jun. 9, 2022

(51) Int. Cl.
*E01H 5/06* (2006.01)
*E02F 3/815* (2006.01)
*E02F 3/76* (2006.01)

(52) U.S. Cl.
CPC ..... *E01H 5/066* (2013.01); *E02F 3/7631* (2013.01); *E02F 3/8155* (2013.01)

(58) Field of Classification Search
CPC ... E01H 5/066; E01H 5/67; E01H 5/65; E02F 3/76; E02F 3/7663; E02F 3/7631; E02F 3/8155; E02F 3/8152; E02F 3/815
See application file for complete search history.

(56) References Cited

U.S. PATENT DOCUMENTS

| | | | | |
|---|---|---|---|---|
| 5,375,349 | A | 12/1994 | Jochim | |
| 5,819,444 | A | 10/1998 | Desmarais | |
| 7,100,311 | B2 * | 9/2006 | Verseef | E01H 5/066 37/234 |
| 7,730,644 | B2 | 6/2010 | Frey et al. | |
| 8,499,477 | B2 | 8/2013 | Gamble, II | |
| 10,053,826 | B1 * | 8/2018 | Null | E01H 5/067 |
| 2017/0226711 | A1 * | 8/2017 | Roberge | E01H 5/061 |
| 2017/0298583 | A1 * | 10/2017 | Budrow | E01H 5/061 |
| 2022/0074155 | A1 * | 3/2022 | Hoffman | E01H 5/063 |
| 2022/0090349 | A1 * | 3/2022 | Wuisan | E02F 3/845 |
| 2022/0136193 | A1 * | 5/2022 | Weihl | E01H 5/067 37/232 |

* cited by examiner

*Primary Examiner* — Thomas B Will
*Assistant Examiner* — Audrey L Lusk
(74) *Attorney, Agent, or Firm* — Harrity & Harrity, LLP

(57) ABSTRACT

A blade assembly may include a blade and a wing. The blade may be configured to be pivotably attached to a machine. The wing may be pivotably attached to an end of the blade to adjust a width of the blade assembly. The wing may be movable relative to the blade over a range of motion that is greater than 180 degrees.

11 Claims, 11 Drawing Sheets

ADJUSTABLE BLADE ASSEMBLY

TECHNICAL FIELD

The present disclosure relates generally to a blade assembly and, for example, to a wing assembly of the blade assembly.

BACKGROUND

A machine may utilize a blade to handle material covering a ground surface (e.g., soil, sand, debris, and/or snow). For example, the machine may push the blade to level the material, shape the material, move the material, and/or perform another task associated with the material. Depending on the type of material and/or the task being performed, certain blade shapes may be less favorable than others. As a result, a machine utilizing an ill-suited blade may cause delays in completing a task and/or may reduce the quality of the end result. Furthermore, due to factors associated with the work site (e.g., a shape of the work site, a size of the work site, and/or obstacles present within the work site), the machine may experience difficulty maneuvering the blade as needed to complete the task.

U.S. Pat. No. 7,730,644, which issued to Frey et al. on Jun. 8, 2010, discloses a snowplow with pivoting sideblades. Both sideblades are pivoted or hinged at the respective left and right ends of the mainblade. The hinging structure permits the sideblades to have a full one-eighty degrees range of arcuate movement relative to the mainblade, from perpendicular leading the mainblade to perpendicular trailing the mainblade.

The blade assembly of the present disclosure solves one or more of the problems set forth above and/or other problems in the art.

SUMMARY

In some implementations, a blade assembly comprises: a blade that is configured to be pivotably attached to a machine; and a wing pivotably attached to an end of the blade to adjust a width of the blade assembly, wherein the wing is movable relative to the blade over a range of motion that is greater than 180 degrees.

In some implementations, a blade assembly comprises: a support structure having a wheel, wherein the wheel is configured to rotate about an axis; a blade having a pivot mechanism that pivotably attaches the blade to the support structure, wherein the blade is movable relative to the axis over a first range of motion; and a wing pivotably attached to an end of the blade, wherein the wing is movable relative to the blade over a second range of motion, wherein the second range of motion is greater than the first range of motion by approximately 180 degrees.

In some implementations, a wing assembly for a grader blade includes a wing; and a rotation mechanism comprising: a first pin extending through the wing and configured to pivotably connect the wing and the grader blade, a second pin extending through and pivotably connecting the wing and a first linkage, a third pin extending through and pivotably connecting the first linkage and a second linkage, and a fourth pin extending through the second linkage and configured to pivotably connect the second linkage and the grader blade.

DETAILED DESCRIPTION

Figure 1:
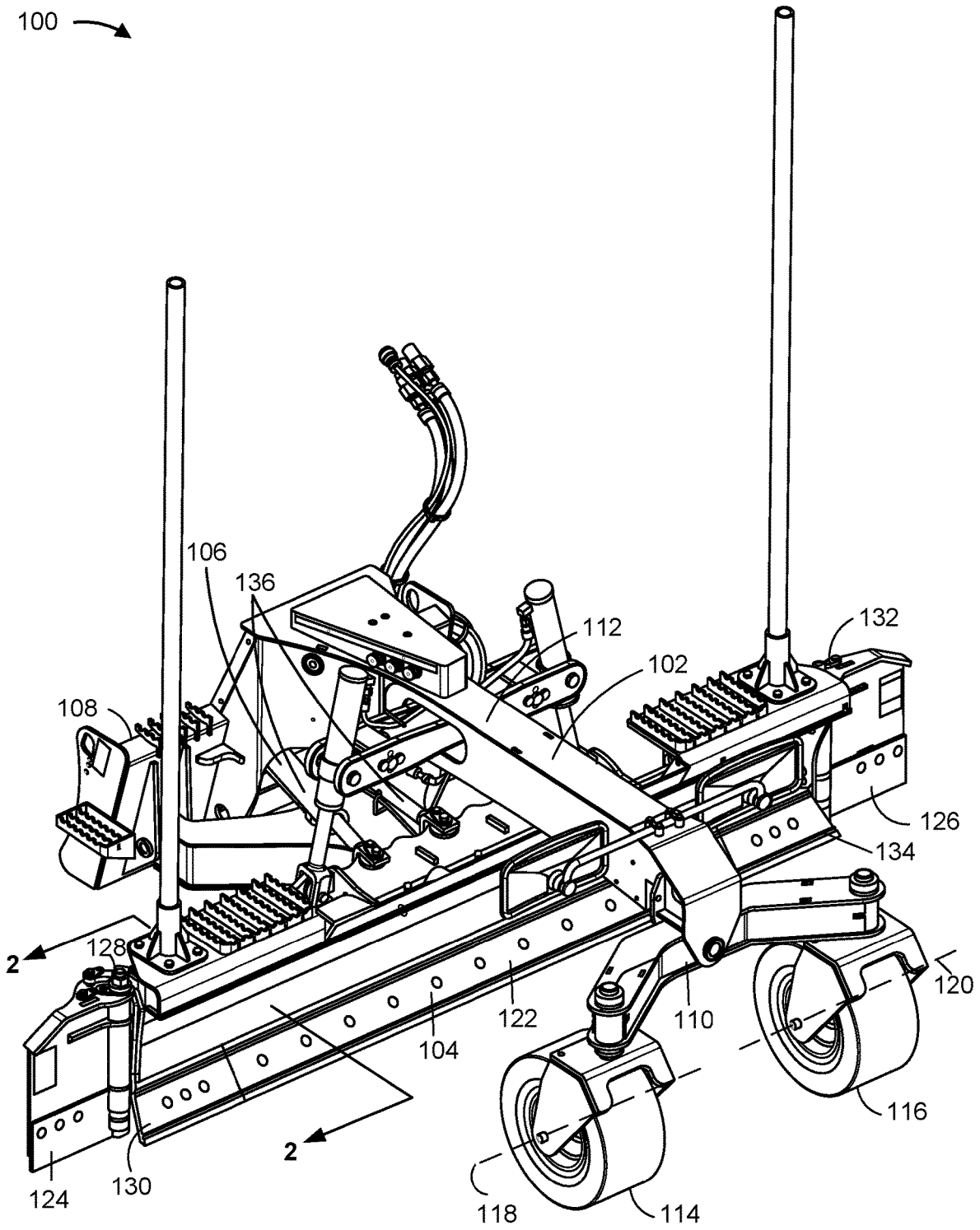
FIG. 1 is a front isometric view of an exemplary blade assembly described herein.

This disclosure relates to a blade assembly, which is applicable to any machine involved in handling material (e.g., soil, sand, debris, and/or snow). For example, the machine may be a movable machine, such as a loader (e.g., a skid steer loader, a compact track loader, a multi-terrain loader, and/or a wheel loader), a dozer, a motor grader, a tractor, or another type of machine.

To simplify the explanation below, the same reference characters may be used to denote like features. The drawings may not be to scale.

FIG. 1 depicts an exemplary blade assembly 100. As shown in FIG. 1, the blade assembly 100 includes a support structure 102, a blade unit 104, and a pivot mechanism 106 that pivotably attaches the blade unit 104 to the support structure 102. The support structure 102 is a device that is configured to support the blade unit 104 during movement thereof. The support structure 102 includes a rear mounting portion 108, which is configured to be mounted to a front end of a machine, a front wheel portion 110, which is configured to move along a ground surface, and a frame 112 connecting the rear mounting portion 108 to the front wheel portion 110. The front wheel portion 110 includes a first wheel 114 and a second wheel 116, which are configured to rotate, respectively, about a first axis 118 and a second axis 120.

The blade unit 104 is a device that is configured to move along a ground surface and directly engage and move material thereon (e.g., soil, sand, debris, and/or snow). The blade unit 104 includes a blade 122 (e.g., a grader blade, a dozer blade, a snowplow blade, or a similar type of blade), a first wing 124, and a second wing 126. The first wing 124 and the second wing 126 are movable with respect to the blade 122 to adjust a width of the blade assembly 100. The first wing 124 is pivotably attached, via a first rotation mechanism 128, to a first end 130 of the blade 122. The second wing 126, which may be operated independently of the first wing 124, is pivotably attached, via a second rotation mechanism 132, to a second end 134 of the blade 122.

In order to move material covering a relatively large surface area, the blade 122 has a width (e.g., between the first end 130 and the second end 134) in a range of approximately 185 centimeters (cm) to approximately 305 cm. In some implementations, the range may be approximately 190 cm to approximately 250 cm. As an example, the width may be approximately 200 cm. As another example, the width may be approximately 245 cm. The first wing, which is substantially identical to the second wing, may have a width in a range of approximately 25 cm to approximately 35 cm. For example, the width may be approximately 30 cm.

To allow the blade unit 104 to avoid obstacles and/or cover a narrower path along the ground surface, the pivot mechanism 106 is configured to articulate the blade unit 104 with respect to the frame 112 over a first range of motion. The first range of motion may be, for example, approximately 30 degrees. The pivot mechanism 106 may include a pair of actuators 136 (e.g., hydraulic actuators, electric actuators, and/or pneumatic actuators), which may be controlled by an operator and/or a control system of the machine to move the blade unit 104 through the first range of motion.

As indicated above, FIG. 1 is provided as an example. Other examples may differ from what is described with regard to FIG. 1. For example, the number and arrangement of components (e.g., the support structure 102, the blade 122, and/or the pivot mechanism 106) may differ from that shown in FIG. 1. Thus, there may be additional components, fewer components, different components, differently sized components, differently shaped components, and/or differently arranged components than those shown in FIG. 1.

An end portion of the blade unit 104, which includes the first end 130 of the blade 122, the first wing 124, and the first rotation mechanism 128, will be described below in connection with FIGS. 2-11. However, it should be understood that the end portion of the blade unit 104 is substantially identical to an opposite end portion of the blade unit 104, which includes the second end 134 of the blade 122, the second wing 126, and the second rotation mechanism 132. Thus, it should be understood that the structure and functionality described below equally applies to the opposite end portion of the blade assembly. To simplify the following explanation, the first wing 124 will hereinafter be referred to as the wing 124, and the first rotation mechanism 128 will hereinafter be referred to as the rotation mechanism 128.

Figure 2:
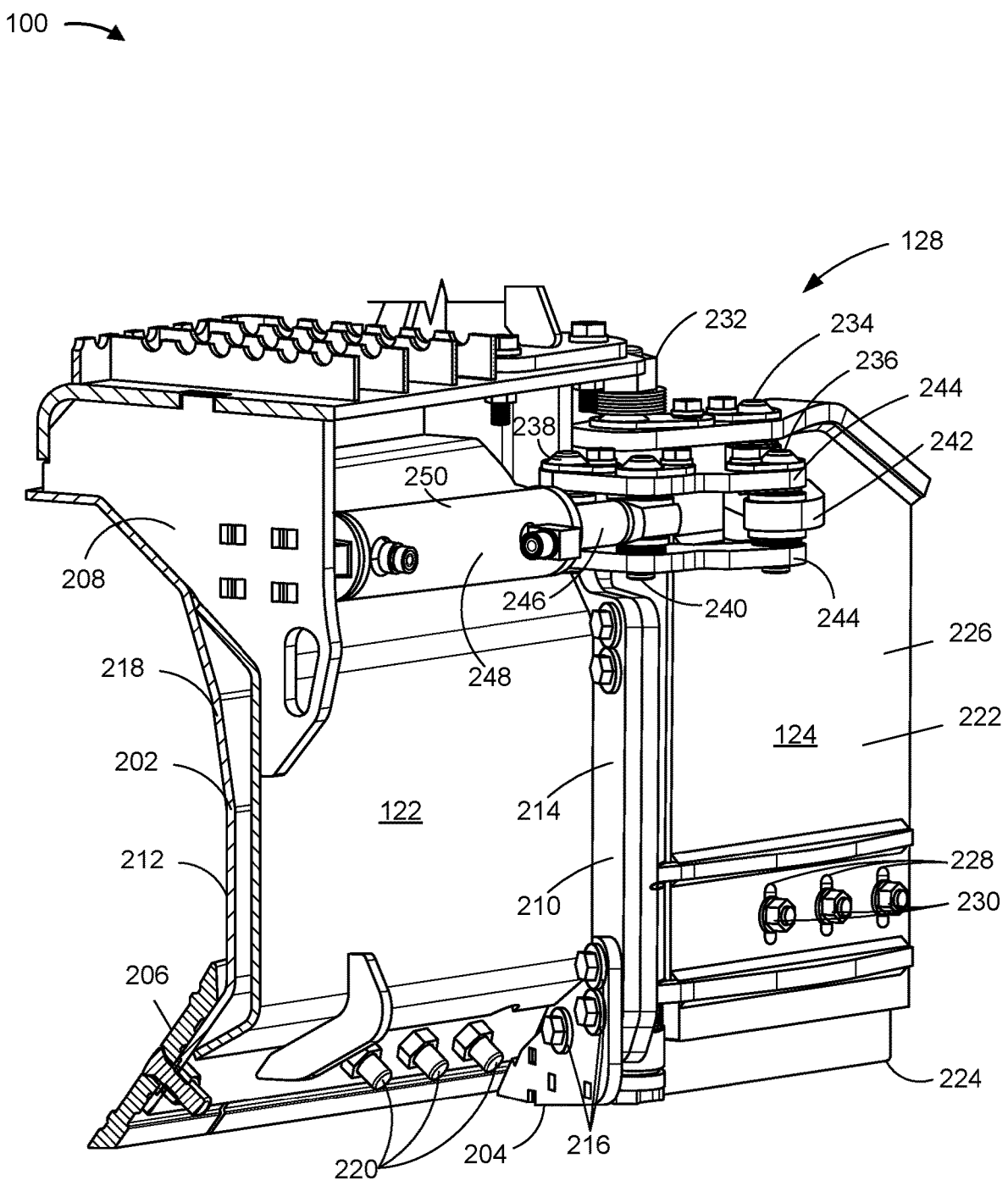
FIG. 2 is a cross-sectional view of the blade assembly, taken along lines 2-2 of FIG. 1, which includes a pivotable wing.

FIG. 2 depicts the end portion of the blade assembly 100. As shown in FIG. 2, the end portion includes the blade 122, the wing 124, and the rotation mechanism 128. The blade 122 includes a blade body 202, a stopper 204, and a first plurality of blade elements 206. The blade body 202, which may be substantially rectangular, includes a divider 208, an attachment structure 210, and a wall 212 connecting the divider 208 to the attachment structure 210. The stopper 204, which plugs a gap between the blade 122 and the wing 124 to prevent material from passing therethrough, may be substantially triangular. To plug the gap, the stopper 204 is fixedly connected to an interior surface 214 of the attachment structure 210. For example, the stopper 204 may be connected to the attachment structure 210 with a first plurality of fasteners 216, such as bolts, screws, nuts, washers, and/or a combination thereof. The first plurality of blade elements 206, which are configured to contact the ground surface, are removably attached to a front surface 218 of the wall 212. For example, the first plurality of blade elements 206 may be attached to the wall 212 via a second plurality of fasteners 220, such as bolts, screws, nuts, washers, and/or a combination thereof. Each of the first plurality of blade elements 206 may be substantially rectangular, substantially trapezoidal, or a similar shape.

Figure 3:
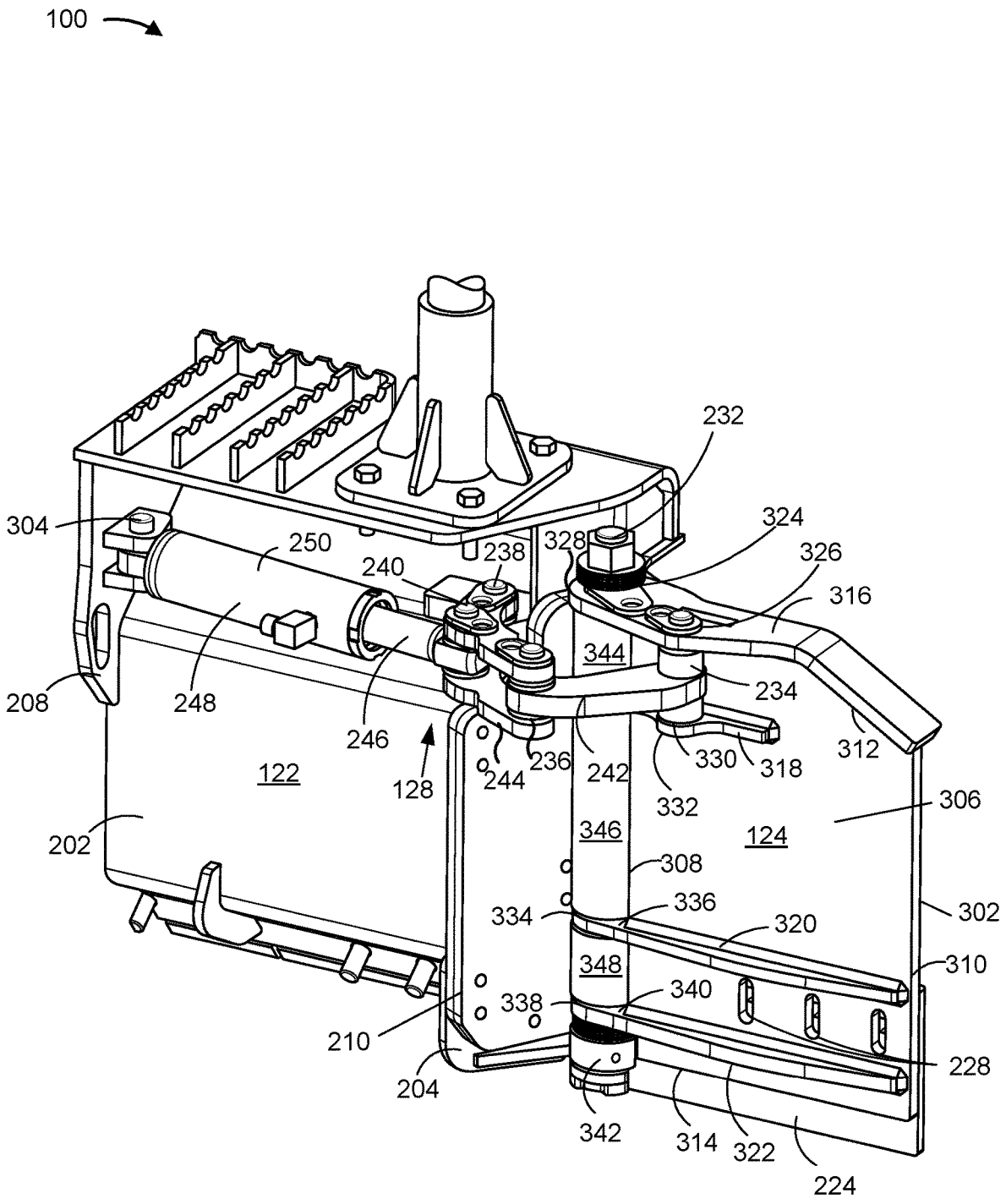
FIG. 3 is a rear isometric view of the blade assembly, with the pivotable wing arranged in an outward position.

The wing 124, which will be described in further detail below, includes a wing body 222 and a second blade element 224. The wing body 222, which may be substantially rectangular, includes a wall 226 having a plurality of slots 228 extending therethrough. The second blade element 224 is configured to contact the ground surface and is removably and adjustably attached to a front surface 302 (e.g., as shown in FIG. 3) of the wall 226. For example, a third plurality of fasteners 230 (e.g., bolts, screws, nuts, washers, and/or a combination thereof) may extend through the second blade element 224 and the plurality of slots 228 to secure the second blade element 224 to the wing body 222. Because the plurality of slots 228 allow the third plurality of fasteners 230 to be secured to different portions thereof, the second blade element 224 may be vertically adjustable relative to the wing body 222 (e.g., to accommodate different types of terrain). The second blade element 224 may be substantially rectangular, substantially trapezoidal, or a similar shape.

The rotation mechanism 128 is configured to pivot the wing 124 over a second range of motion relative to the blade 122 between a forward position (described in connection with FIGS. 6-8) and a rearward position (described in connection with FIGS. 9-11). It should be understood that the wing 124 is freely movable within the second range of motion and may therefore be arranged in any position between the forward position and the rearward position. For example, as will be described in connections with FIGS. 3-5, the wing 124 may be arranged in an outward position, which defines a maximum width of the blade assembly 100. To permit the wing 124 to be moved into a position that is substantially parallel to a direction of travel of the machine having the blade assembly 100, regardless of the angle of the wing 124 within the first range of motion (e.g., a 10 degree angle, a 30 degree angle, etc.), the second range of motion is greater than the first range of motion by approximately 180 degrees. For example, if the first range of motion is approximately 30 degrees, the second range of motion may be approximately 210 degrees.

To allow the wing 124 to move over the second range of motion relative to the blade 122, the rotation mechanism 128 includes six points of rotation, which are respectively defined by six pins. The six pins include a first pin 232, a second pin 234, a third pin 236, a fourth pin 238, a fifth pin 240, and a sixth pin 304 (shown in FIG. 3). Each of the six pins, which are substantially cylindrical to allow components to pivot therearound, may include a rivet, a bolt, a nut, one or more washers, one or more bushings, and/or a combination thereof.

The first pin 232 extends through and pivotably connects the wing 124 and the attachment structure 210 of the blade body 202. The second pin 234 extends through and pivotably connects the wing 124 and a first linkage 242. The third pin 236 extends through and pivotably connects the first linkage 242 and a pair of second linkages 244. The fourth pin 238 extends through and pivotably connects the second pair of linkages 244 and the attachment structure 210 of the blade body 202. The fifth pin 240 extends through and pivotably connects the second pair of linkages 244 and a piston rod 246 of an actuator 248. The piston rod 246, which may be controlled by the operator and/or the control system of the machine, is slidably movable within and extendable from a housing 250 of the actuator 248. The sixth pin 304 extends through and pivotably connects the housing 250 of the actuator 248 and the divider 208 of the blade body 202. The actuator 248 may be a hydraulic actuator, a pneumatic actuator, an electric actuator, or another type of actuator.

As indicated above, FIG. 2 is provided as an example. Other examples may differ from what is described with regard to FIG. 2. For example, the number and arrangement of components (e.g., the blade body 202, the stopper 204, the first plurality of blade elements 206, the wing body 222, the second blade element 224, the six pins, the first linkage 242, the pair of second linkages 244, and/or the actuator 248) may differ from that shown in FIG. 2. Thus, there may be additional components, fewer components, different components, differently sized components, differently shaped components, and/or differently arranged components than those shown in FIG. 2.

Figure 4:
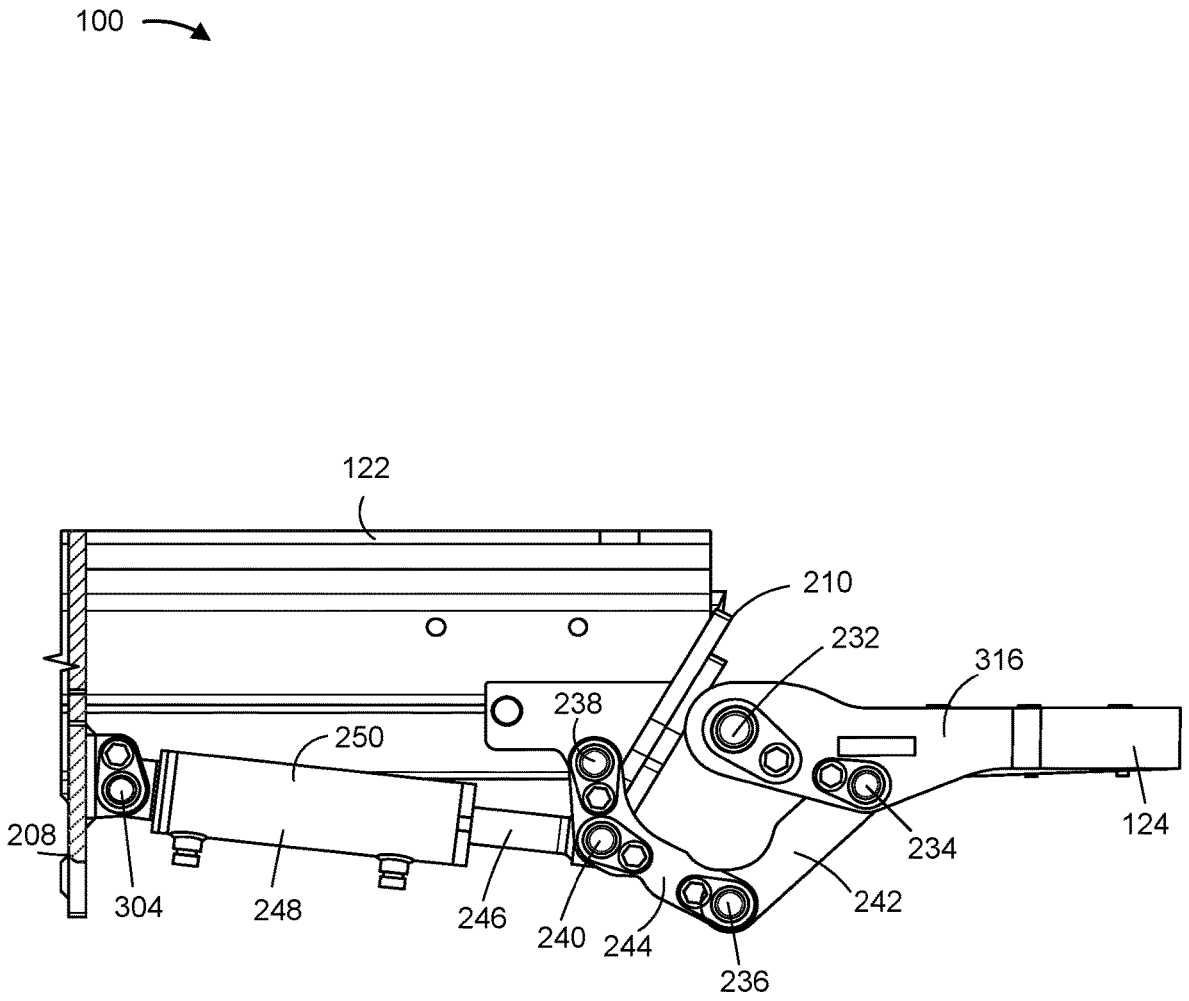
FIG. 4 is a top view of the blade assembly, with the pivotable wing arranged in the outward position.
Figure 5:
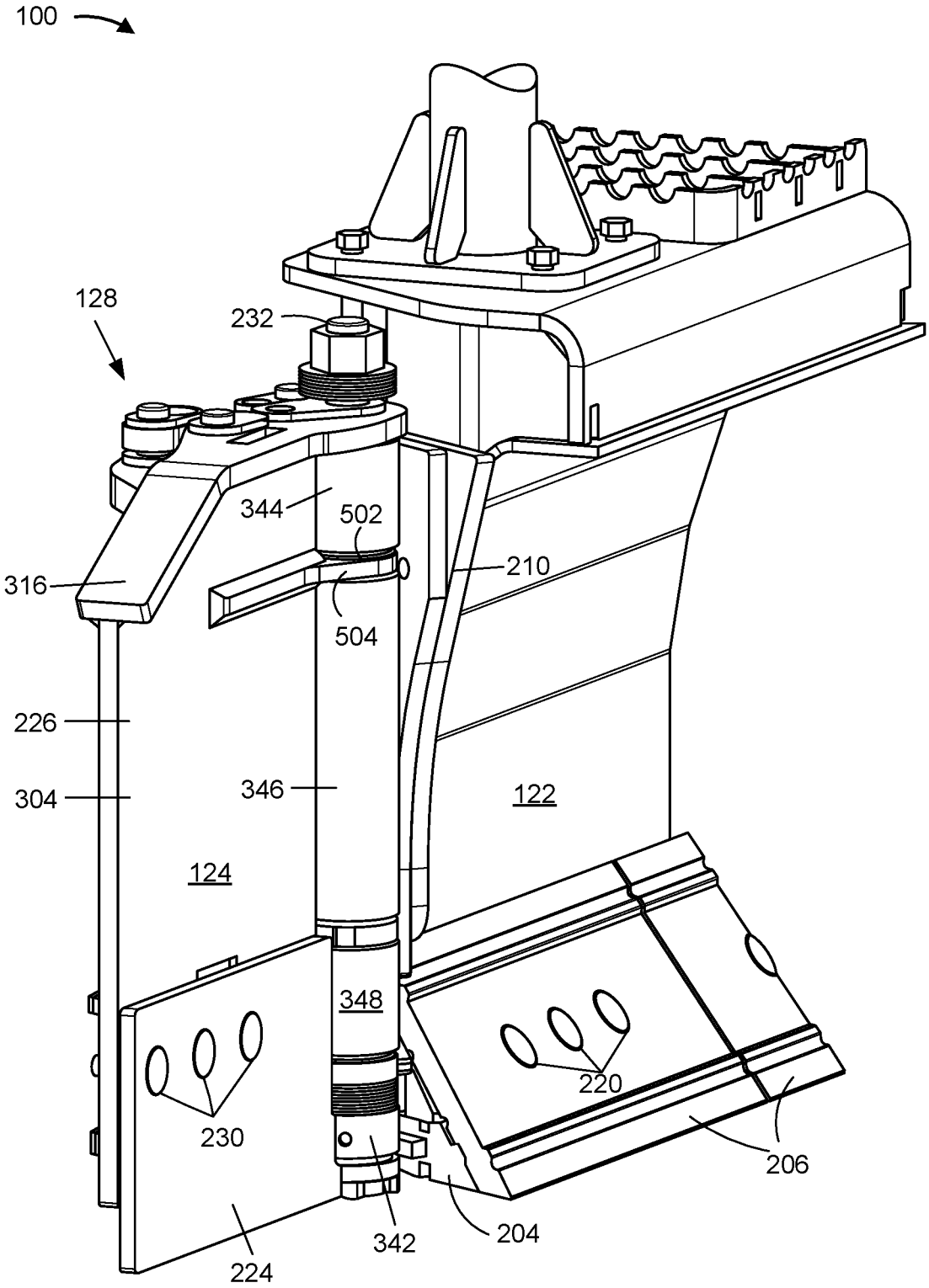
FIG. 5 is a front isometric view of the blade assembly, with the pivotable wing arranged in the outward position.

FIGS. 3-5 depict the end portion of the blade assembly 100 with the wing 124 arranged in the outward position. As shown in FIGS. 3-5, the wing 124 may be arranged in the outward position, which defines the maximum width of the blade assembly 100. In the outward position, the front surface 302 of the wing 124 forms an approximately 180 degree angle with the front surface 218 of the blade 122, and as a result, allows the blade assembly 100 to form a greater width to move more material in a single pass over the ground surface. Because the wing 124 is arranged in the outward position relative to the blade 122, the blade assembly 100 is shaped as a grader blade and may therefore be used to level the material.

The wall 226 of the wing body 222, in addition to having the front surface 302, includes a rear surface 306, an inner side surface 308, an outer side surface 310, an upper end 312, and a lower end 314. The front surface 302 is opposite the rear surface 306, the inner side surface 308 is opposite the outer side surface 310, and the upper end 312 is opposite the lower end 314. The wing body 222, in addition to having the wall 226, includes an upper rim 316, a first ledge 318, a second ledge 320, and a third ledge 322. The upper rim 316 extends along the upper end 312 of the wall 226 and includes a first hole 324 and a second hole 326, which respectively receive the first pin 232 and the second pin 234. The first hole 324 is formed in a first ear portion 328 of the upper rim 316, which projects inwardly from the inner side surface 308. The first ledge 318 extends along the rear surface 306 of the wall 226 and includes a third hole 502 (shown in FIG. 5) and a fourth hole 330, which respectively receive the first pin 232 and the second pin 234. The third hole 502 is formed in a second ear portion 504 (shown in FIG. 5) of the first ledge 318, which projects inwardly from the inner side surface 308. The fourth hole 330 is formed in a seat portion 332 of the first ledge 318, which projects rearwardly from the rear surface 306. The second ledge 320 extends along the rear surface 306 of the wall 226 and includes a fifth hole 334 that receives the first pin 232. The fifth hole 334 is formed in a third ear portion 336 of the second ledge 320, which projects inwardly from the inner side surface 308. The third ledge 322 is substantially identical to the second ledge 320. Thus, the third ledge 322 likewise extends along the rear surface 306 and includes a sixth hole 338 within a fourth ear portion 340. The sixth hole 338 receives the first pin 232.

To allow the second blade element 224 to pivot with the wing body 222 relative to the blade body 202, the second blade element 224 includes a loop portion 342 that receives the first pin 232. Similarly, the attachment structure 210 of the blade body 202 includes a first hollow cylindrical portion 344, a second hollow cylindrical portion 346, and a third hollow cylindrical portion 348, which receive the first pin 232. As shown in FIGS. 3-5, the first hollow cylindrical portion 344, the second hollow cylindrical portion 346, the third hollow cylindrical portion 348, and the loop portion 342 are alternatingly arranged on the first pin 232 relative to the first ear portion 328, the second ear portion 504, the third ear portion 336, and the fourth ear portion 340.

As indicated above, FIGS. 3-5 are provided as an example. Other examples may differ from what is described with regard to FIGS. 3-5. For example, the number and arrangement of components (e.g., the upper rim 316, the first ledge 318, the second ledge 320, the third ledge 322, the loop portion 342, the first hollow cylindrical portion 344, the second hollow cylindrical portion 346, and/or the third hollow cylindrical portion 348) may differ from that shown in FIGS. 3-5. Thus, there may be additional components, fewer components, different components, differently sized components, differently shaped components, and/or differently arranged components than those shown in FIGS. 3-5.

Figure 6:
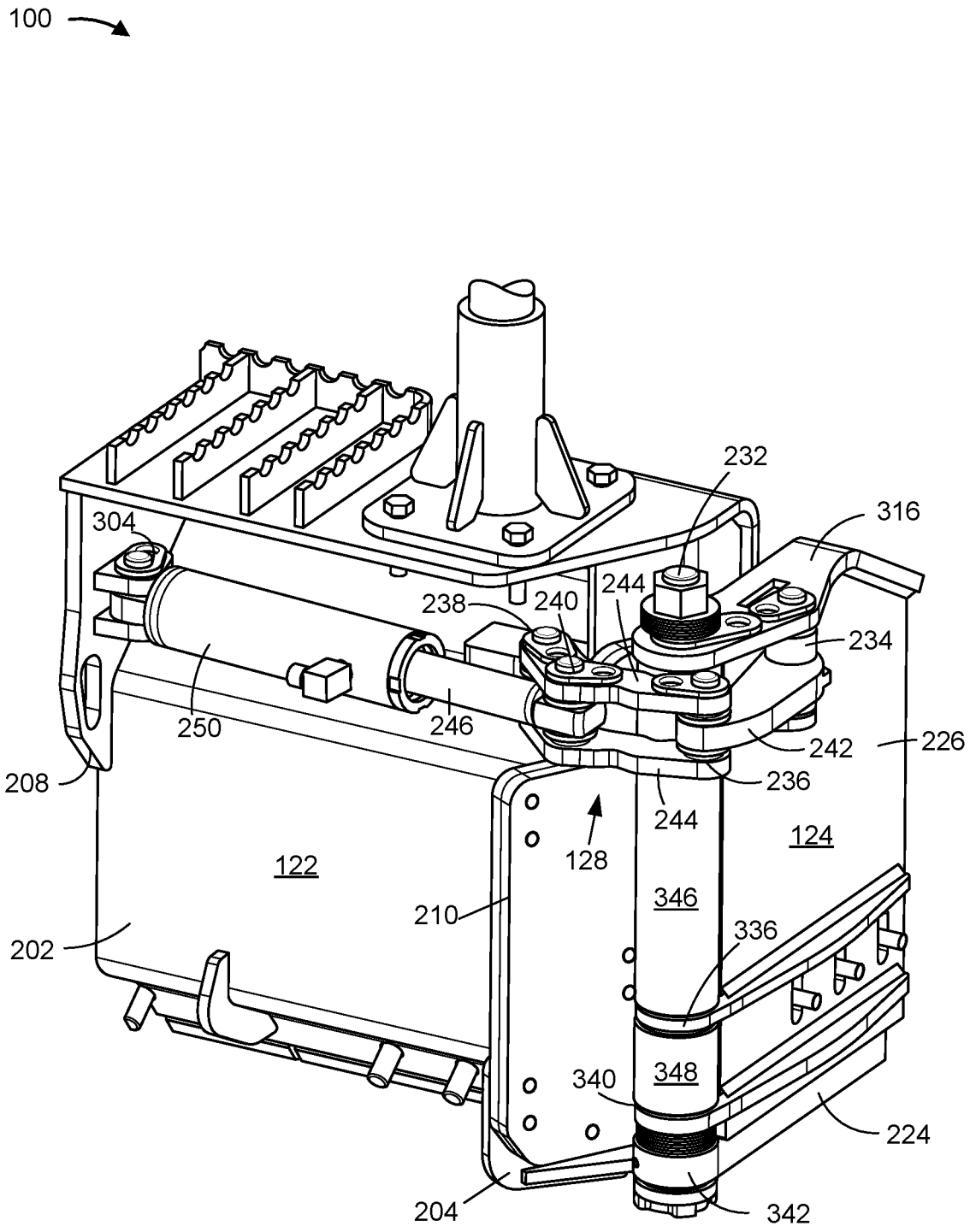
FIG. 6 is a rear isometric view of the blade assembly, with the pivotable wing arranged in a forward position.
Figure 7:
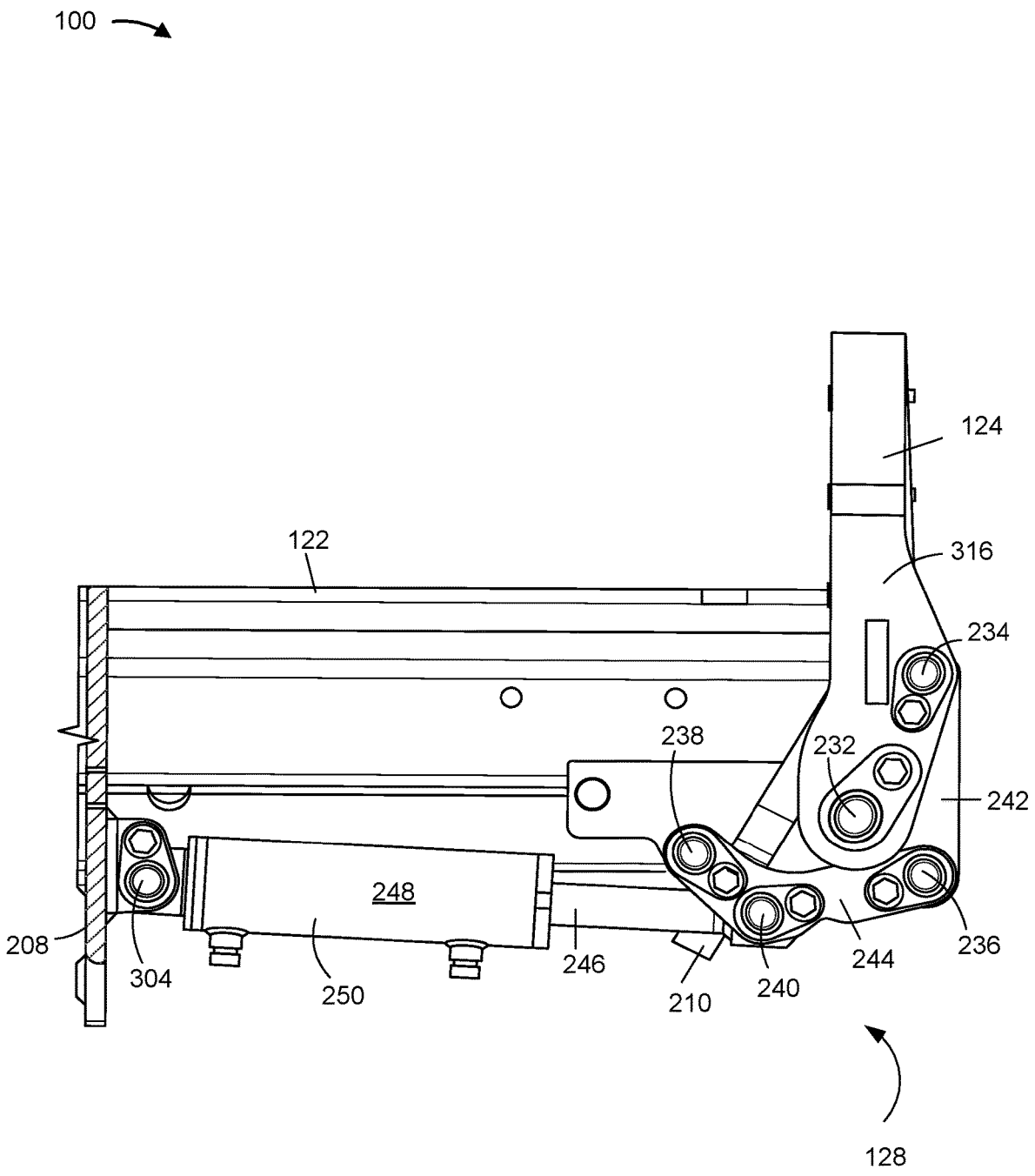
FIG. 7 is a top view of the blade assembly, with the pivotable wing arranged in the forward position.
Figure 8:
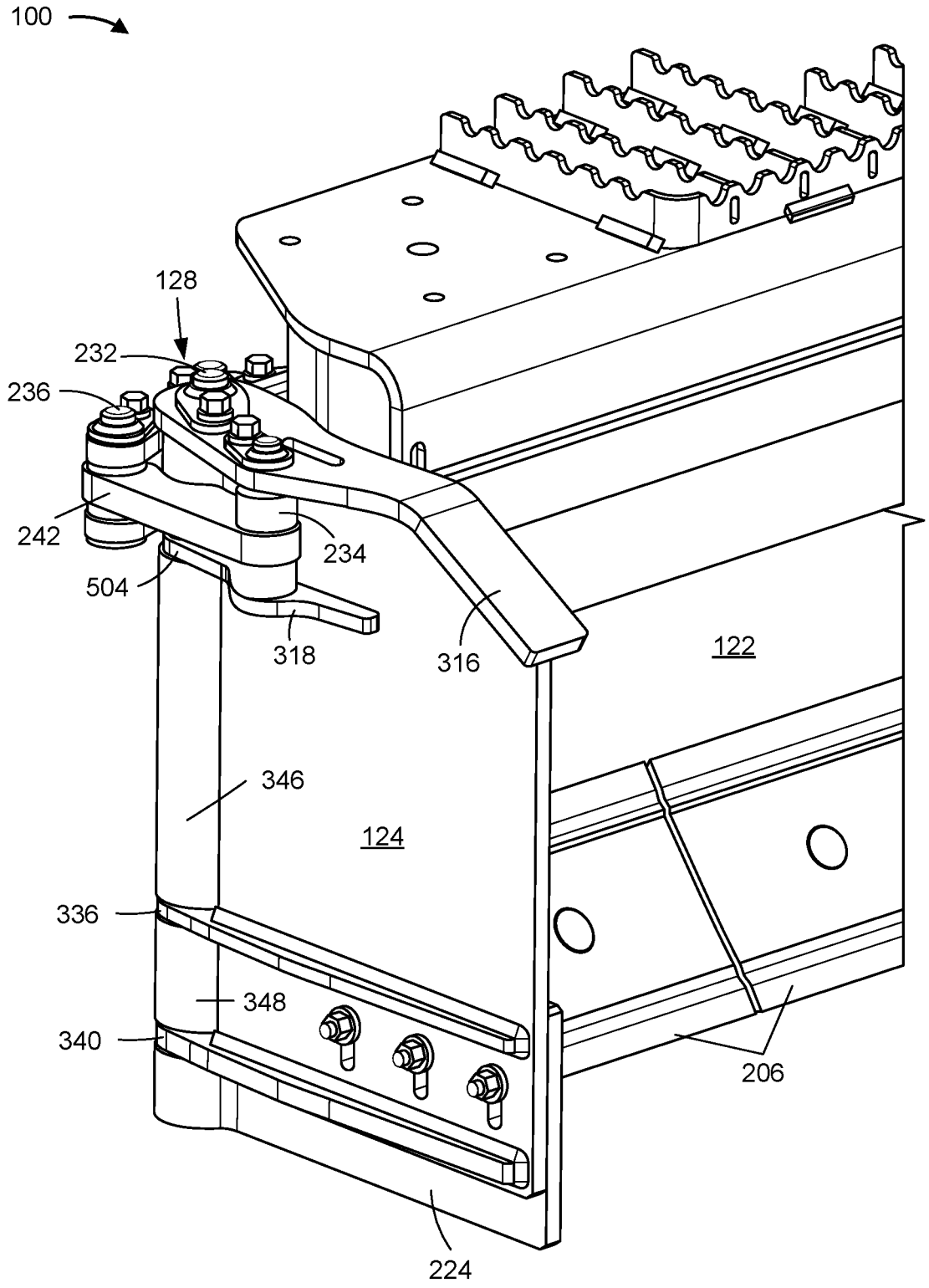
FIG. 8 is a front isometric view of the blade assembly, with the pivotable wing arranged in the forward position.

FIGS. 6-8 depict the end portion of the blade assembly 100, with the wing 124 arranged in the forward position. As shown in FIGS. 6-8, the wing 124 may be arranged in the forward position, which defines a first end of the second range of motion. In the forward position, the front surface 302 of the wing 124 forms an approximately 90 degree angle with the front surface 218 of the blade 122, and as a result, allows the blade assembly 100 to function as a box blade. In other words, because the wing 124 is folded in the forward position relative to the blade 122, the blade assembly 100 is configured as a box blade and may therefore be used to receive and/or push the material.

To move the wing 124 toward the forward position, the control system of the machine actuates the hydraulic actuator 248 such as by causing hydraulic fluid to fill a cylinder (not shown) within the housing 250 along a direction that drives the piston rod 246 outward. As the piston rod 246 extends out of the housing 250, the piston rod 246 drives the pair of second linkages 244 to rotate in a counterclockwise direction about the fourth pin 238. As the pair of second linkages 244 rotate, the pair of second linkages 244 drive the first linkage 242 forward, which in turn causes the wing 124 to move in a counterclockwise direction about the first pin 232. As the hydraulic fluid fills the housing 250, the wing 124 continues to rotate until the front surface 302 of the wing 124 abuts the first end 130 of the blade 122 to form the forward position.

As indicated above, FIGS. 6-8 are provided as an example. Other examples may differ from what is described with regard to FIGS. 6-8. For example, the number and arrangement of components may differ from that shown in FIGS. 6-8. Thus, there may be additional components, fewer components, different components, differently sized components, differently shaped components, and/or differently arranged components than those shown in FIGS. 6-8.

Figure 9:
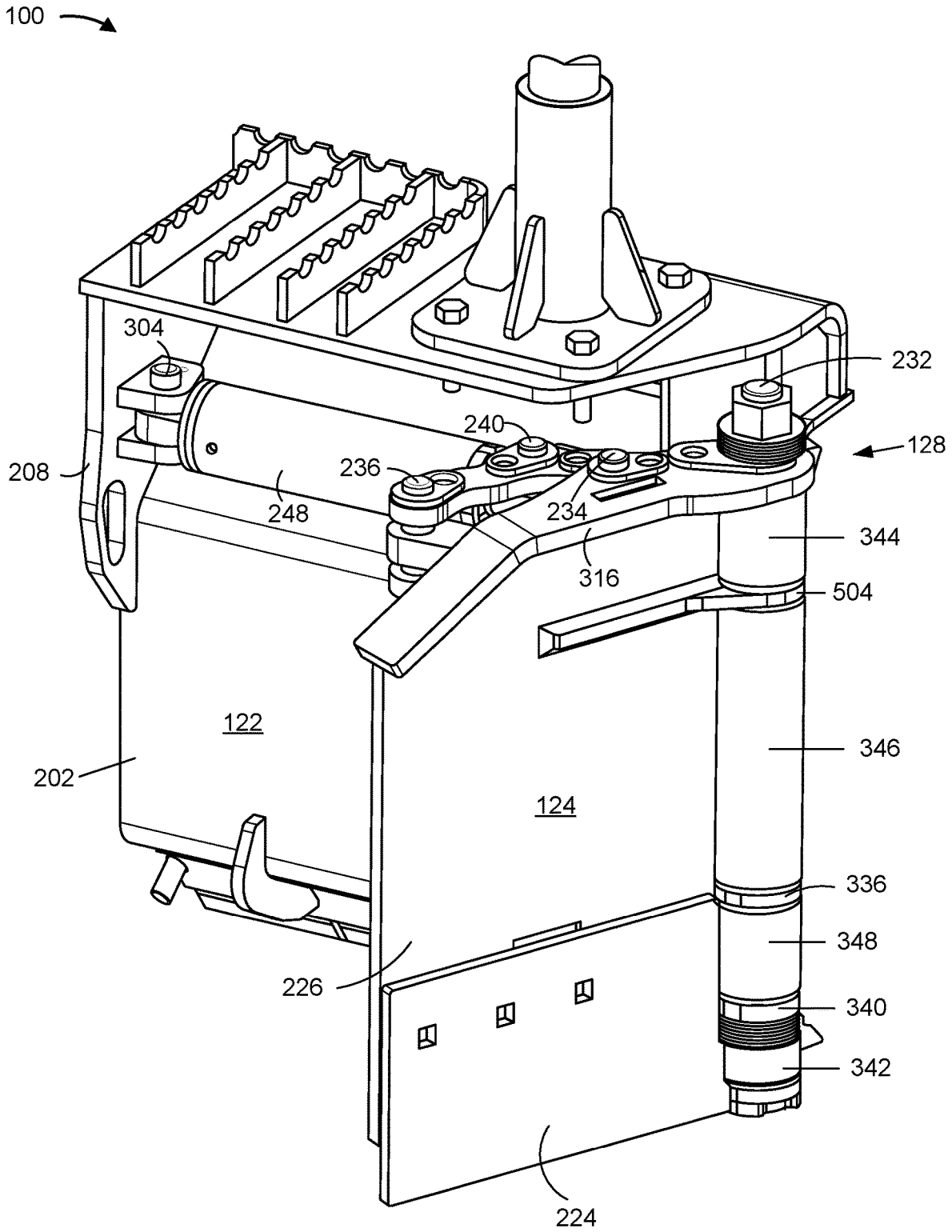
FIG. 9 is a rear isometric view of the blade assembly, with the pivotable wing arranged in a rearward position.
Figure 10:
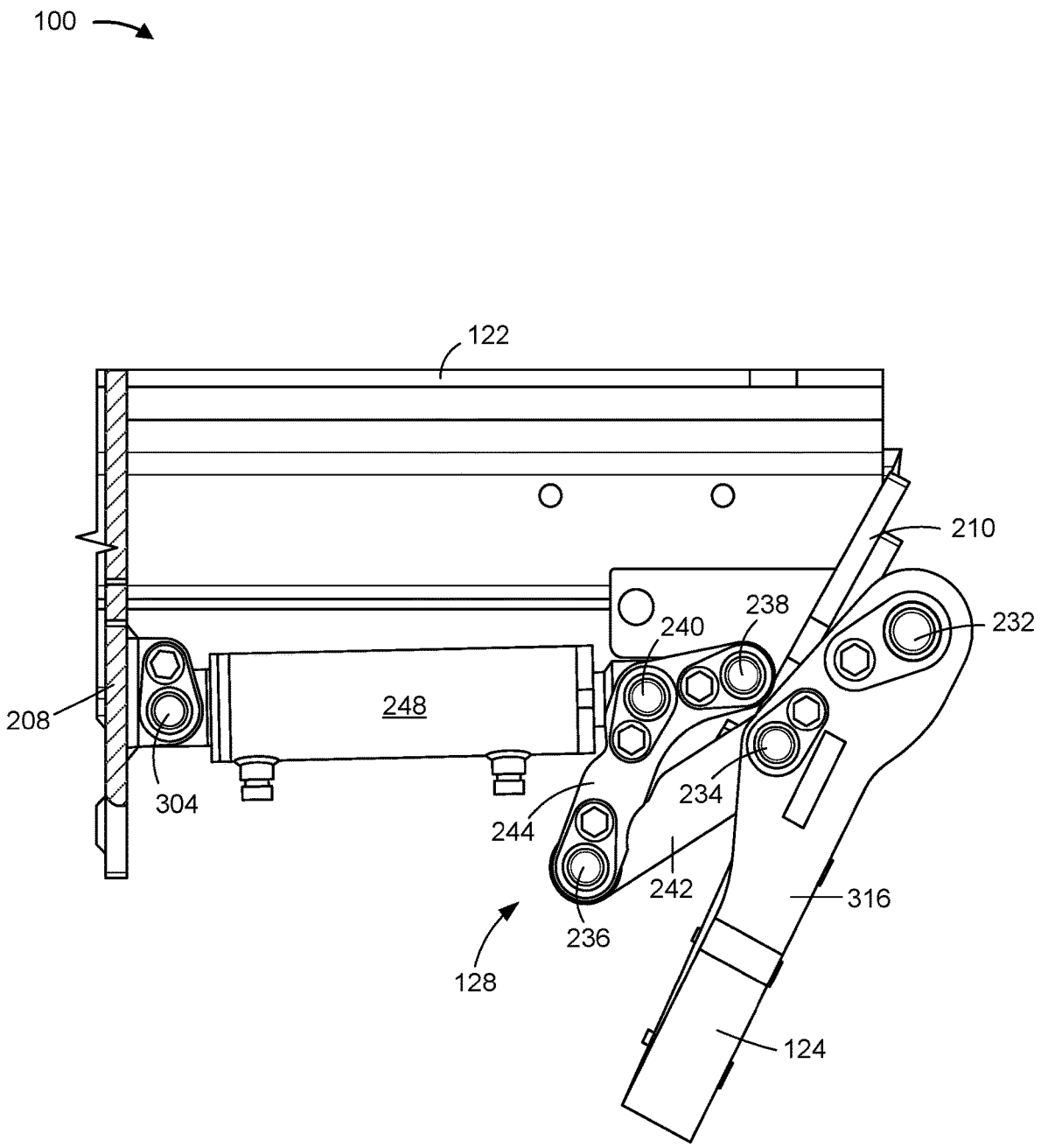
FIG. 10 is a top view of the blade assembly, with the pivotable wing arranged in the rearward position.
Figure 11:
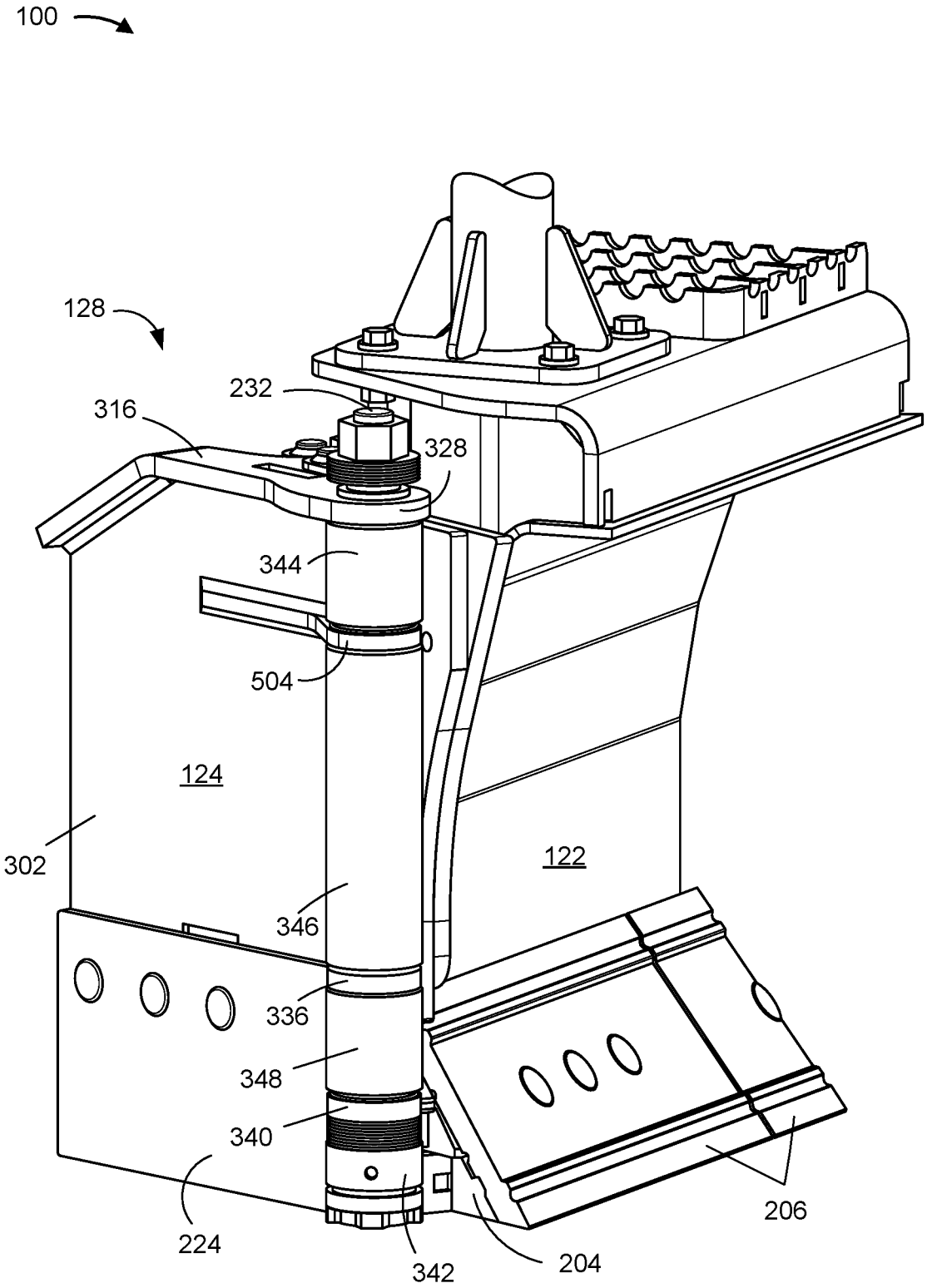
FIG. 11 is a front isometric view of the blade assembly, with the pivotable wing arranged in the rearward position.

FIGS. 9-11 depict the end portion of the blade assembly 100, with the wing 124 arranged in the rearward position. As shown in FIGS. 9-11, the wing 124 may be arranged in the rearward position, which defines a second end of the second range of motion. In the rearward position, the front surface 302 of the wing 124 forms an approximately 300 degree angle with the front surface 218 of the blade 122, and as a result, allows the blade assembly 100 to function as a grader blade. In other words, because the wing 124 is folded in the rearward position relative to the blade 122, the blade assembly 100 is configured as a grader blade and may therefore be used to level the material.

To move the wing 124 toward the rearward position, the control system of the machine actuates the hydraulic actuator 248 such as by causing hydraulic fluid to fill the cylinder (not shown) within the housing 250 along a direction that drives the piston rod 246 inward. As the piston rod 246 slides into the housing 250, the piston rod 246 causes the pair of second linkages 244 to rotate in a clockwise direction about the fourth pin 238. As the pair of second linkages 244 rotate, the pair of second linkages 244 pull the first linkage 242 inward and rearward, which in turn causes the wing 124 to move in a clockwise direction about the first pin 232. As the hydraulic fluid fills the housing 250, the wing 124 continues to rotate until the rear surface 306 of the wing 124 abuts the attachment structure 210 of the blade 122 to form the rearward position.

As indicated above, FIGS. 9-11 are provided as an example. Other examples may differ from what is described with regard to FIGS. 9-11. For example, the number and arrangement of components may differ from that shown in FIGS. 9-11. Thus, there may be additional components, fewer components, different components, differently sized components, differently shaped components, and/or differently arranged components than those shown in FIGS. 9-11.

INDUSTRIAL APPLICABILITY

The blade assembly 100 of the present disclosure is particularly applicable to a machine involved in handling material (e.g., soil, sand, debris, and/or snow). For example, the machine may utilize the blade assembly 100 to level the material, shape the material, move the material, or perform another task. As indicated above, the machine may be a movable machine, such as a loader (e.g., a skid steer loader, a compact track loader, a multi-terrain loader, and/or a wheel loader), a dozer, a motor grader, a tractor, or another type of machine.

Because the blade 122 is movable relative to the machine over the first range of motion, and the wing 124 is movable relative to the blade 122 over the second range motion, which exceeds the first range of motion by approximately 180 degrees, the blade assembly 100 of the present disclosure has increased maneuverability and versatility. As a result, the blade assembly 100 may reduce an amount of time to complete a task, facilitate completion of the task, and/or improve the quality of the end result. Additionally, by plugging the gap between the blade 122 and the wing 124, the stopper 204 prevents material from passing therebetween. Thus, the stopper 204 may further reduce the amount of time to complete the task, facilitate completion of the task, and/or improve the quality of the end result.

The foregoing disclosure provides illustration and description, but is not intended to be exhaustive or to limit the implementations to the precise form disclosed. Modifications and variations may be made in light of the above disclosure or may be acquired from practice of the implementations. Furthermore, any of the implementations described herein may be combined unless the foregoing disclosure expressly provides a reason that one or more implementations cannot be combined. Even though particular combinations of features are recited in the claims and/or disclosed in the specification, these combinations are not intended to limit the disclosure of various implementations. Although each dependent claim listed below may directly depend on only one claim, the disclosure of various implementations includes each dependent claim in combination with every other claim in the claim set.

As used herein, "a," "an," and a "set" are intended to include one or more items, and may be used interchangeably with "one or more." Further, as used herein, the article "the" is intended to include one or more items referenced in connection with the article "the" and may be used interchangeably with "the one or more." Further, as used herein, the terms "comprises," "comprising," "having," "including," or other variations thereof, are intended to cover non-exclusion, such that a process, method, article, or apparatus that comprises a list of elements does not include only those elements, but may include other elements not expressly listed. In addition, in this disclosure, relative terms, such as, for example, "about," "generally," "substantially," and "approximately" are used to indicate a possible variation of ±10% of the stated value, except where otherwise apparent to one of ordinary skill in the art from the context. Further, the phrase "based on" is intended to mean "based, at least in part, on" unless explicitly stated otherwise. Also, as used herein, the term "or" is intended to be inclusive when used in a series and may be used interchangeably with "and/or," unless explicitly stated otherwise (e.g., if used in combination with "either" or "only one of"). Further, spatially relative terms, such as "below," "lower," "above," "upper," and the like, may be used herein for ease of description to describe one element or feature's relationship to another element(s) or feature(s) as illustrated in the figures. The spatially relative terms are intended to encompass different orientations of the apparatus, device, and/or element in use or operation in addition to the orientation depicted in the figures. The apparatus may be otherwise oriented (rotated 90 degrees or at other orientations) and the spatially relative descriptors used herein may likewise be interpreted accordingly.

What is claimed is:

1. A blade assembly comprising:

a support structure having a frame;

a blade pivotably attached to the support structure, wherein the blade is movable relative to the frame over a first range of motion; and a wing pivotably attached to an end of the blade, wherein the wing is movable relative to the blade over a second range of motion, wherein the wing is pivotably attached to the blade via a rotation mechanism, wherein the rotation mechanism includes a first pin, a second pin, a third pin, a fourth pin, a fifth pin, a first linkage, and a pair of second linkages, wherein the second linkages include a second linkage and a third linkage, wherein the first pin pivotably connects the wing to the blade, wherein the second pin pivotably connects the wing to the first linkage, wherein the third pin pivotably connects the first linkage to the second linkage, wherein the fourth pin pivotably connects the third linkage to the blade, wherein the fifth pin pivotably connects the second linkage and the third linkage to an actuator, wherein the first linkage is between where the second pin pivotably connects the wing to the first linkage and where the third pin pivotably connects the first linkage to the second linkage, and wherein the second linkage is between where the fifth pin pivotably connects the second linkage to the actuator and where the third pin pivotably connects the first linkage to the second linkage.

2. The blade assembly of claim 1, wherein the first range of motion is approximately 30 degrees; and the second range of motion is approximately 210 degrees.

3. The blade assembly of claim 1, wherein the rotation mechanism further comprises:

a sixth pin extending through and pivotably connecting the actuator and the blade.

4. The blade assembly of claim 1, wherein the blade includes a stopper that is configured to prevent material from passing between the blade and the wing.

5. The blade assembly of claim 1, wherein the blade comprises:

a body; and at least one blade element removably attached to the body.

6. The blade assembly of claim 1, wherein the wing comprises:

a body; and at least one blade element removably attached to the body.

7. A wing assembly for a grader blade, the wing assembly comprising:

a wing; and a rotation mechanism comprising:

a first pin extending through the wing and configured to pivotably connect the wing and the grader blade, a second pin extending through and pivotably connecting the wing and a first linkage, a third pin extending through and pivotably connecting the first linkage and a second linkage, and a fourth pin extending through the second linkage and configured to pivotably connect the second linkage and the grader blade, wherein the wing includes:

a body, and a blade element removably attached to the body, wherein the first pin extends through the body of the wing and the blade element, wherein the second pin extends through the body of the wing, wherein the blade element includes a loop portion, and wherein the loop portion is configured to receive the first pin.

8. The wing assembly of claim 7, wherein the wing further includes:

an upper rim having a first hole and a second hole, and a ledge having a third hole and a fourth hole;

the first pin further extends through the first hole of the upper rim and the third hole of the ledge; and the second pin further extends through the second hole of the upper rim and the fourth hole of the ledge.

9. The wing assembly of claim 7, wherein the rotation mechanism further comprises:

a fifth pin extending through and pivotably connecting the second linkage and an actuator, and a sixth pin extending through the actuator and configured to pivotably connect the actuator and the grader blade.

10. The wing assembly of claim 9, wherein the actuator is a hydraulic actuator.

11. The wing assembly of claim 7, wherein the wing is substantially rectangular and has a width of approximately 30 centimeters.

* * * * *